US008424710B2

(12) United States Patent
Orgeldinger

(10) Patent No.: US 8,424,710 B2
(45) Date of Patent: Apr. 23, 2013

(54) CRATE

(75) Inventor: Wolfgang Orgeldinger, Pullach (DE)

(73) Assignee: IFCO Systems GmbH, Pullach (DE)

( * ) Notice: Subject to any disclaimer, the term of this patent is extended or adjusted under 35 U.S.C. 154(b) by 25 days.

(21) Appl. No.: 12/885,732

(22) Filed: Sep. 20, 2010

(65) Prior Publication Data

US 2012/0067879 A1 Mar. 22, 2012

(51) Int. Cl.
*B65D 6/16* (2006.01)
*B65D 8/04* (2006.01)
*B65D 90/02* (2006.01)

(52) U.S. Cl.
USPC ..... 220/676; 220/6; 220/645

(58) Field of Classification Search ..... 220/4.28, 220/6, 7, 645, 646, 650, 675, 676, 668, 669
See application file for complete search history.

(56) References Cited

U.S. PATENT DOCUMENTS

| | | | | |
|---|---|---|---|---|
| 3,072,281 | A * | 1/1963 | Reilly | 220/6 |
| 3,315,835 | A * | 4/1967 | Katzman | 220/6 |
| 3,327,896 | A | 6/1967 | Asenbauer | |
| 4,184,625 | A | 1/1980 | Stollberg et al. | |
| 4,619,371 | A | 10/1986 | Rehrig | |
| 4,820,383 | A * | 4/1989 | Shchamorov et al. | 220/6 |
| 4,917,255 | A | 4/1990 | Foy et al. | |
| 5,366,107 | A * | 11/1994 | Rostkowski | 220/676 |
| 5,443,173 | A * | 8/1995 | Emery et al. | 220/6 |
| 5,582,296 | A | 12/1996 | Beauchamp et al. | |
| 7,331,480 | B1 | 2/2008 | Nolan | |
| 2006/0210745 | A1 | 9/2006 | Ringler | |
| 2007/0189932 | A1 | 8/2007 | Glenn et al. | |
| 2009/0151226 | A1 | 6/2009 | Apps et al. | |

FOREIGN PATENT DOCUMENTS

| | | | |
|---|---|---|---|
| DE | 20 2004 018 927 | U1 | 3/2005 |
| DE | 20 2007 015 378 | U1 | 3/2008 |
| EP | 0 374 774 | A2 | 6/1990 |
| EP | 0 846 633 | A1 | 6/1998 |
| EP | 2 072 411 | A2 | 6/2009 |
| GB | 2 359 066 | A | 8/2001 |
| WO | 96/40564 | A1 | 12/1996 |
| WO | 98/56668 | A1 | 12/1998 |
| WO | 00/66440 | A1 | 11/2000 |
| WO | 2009/025627 | A1 | 2/2009 |
| WO | 2009/153694 | A2 | 12/2009 |

OTHER PUBLICATIONS

Official Communication issued in International Patent Application No. PCT/EP2011/065106, mailed on Nov. 23, 2011.
Official Communication issued in International Patent Application No. PCT/EP2011/065108, mailed on Dec. 1, 2011.
Official Communication issued in International Patent Application No. PCT/EP2011/065101, mailed on Nov. 23, 2011.
Official Communication issued in corresponding European Patent Application No. 10177617.7, mailed on Feb. 10, 2011.
Official Communication issued in corresponding European Patent Application No. 10177623.5, mailed on Feb. 10, 2011.
Official Communication issued in corresponding European Patent Application No. 10177637.5, mailed on Feb. 23, 2011.

(Continued)

*Primary Examiner* — Harry Grosso
(74) *Attorney, Agent, or Firm* — Keating & Bennett, LLP

(57) ABSTRACT

A crate includes a bottom, two end walls, and two side walls. At least one of the end and side walls comprises an inlet having a dimension allowing to introduce a predefined amount of cooling liquid into the interior of the crate.

7 Claims, 12 Drawing Sheets

OTHER PUBLICATIONS

Official Communication issued in corresponding European Patent Application No. 10177630.0, mailed on May 27, 2011.
Orgeldinger, "Crate", U.S. Appl. No. 12/885,731, filed Sep. 20, 2010.
Orgeldinger, "Crate", U.S. Appl. No. 12/885,742, filed Sep. 20, 2010.
Orgeldinger, "Crate", U.S. Appl. No. 12/885,746, filed Sep. 20, 2010.
Official Communication issued in International Patent Application No. PCT/EP2011/065104, mailed on Nov. 25, 2011.

* cited by examiner

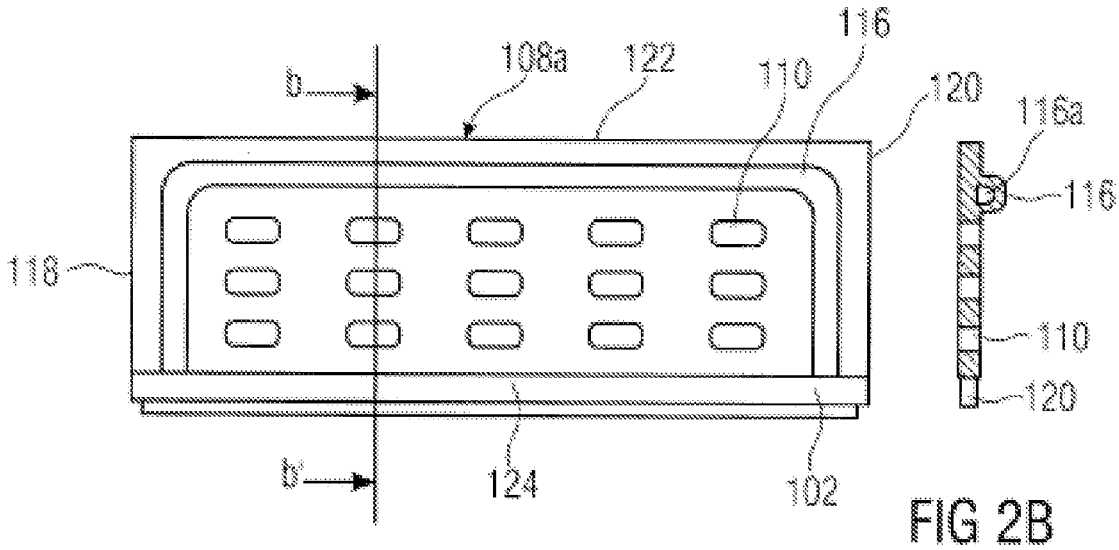
FIG 2B
FIG 2A
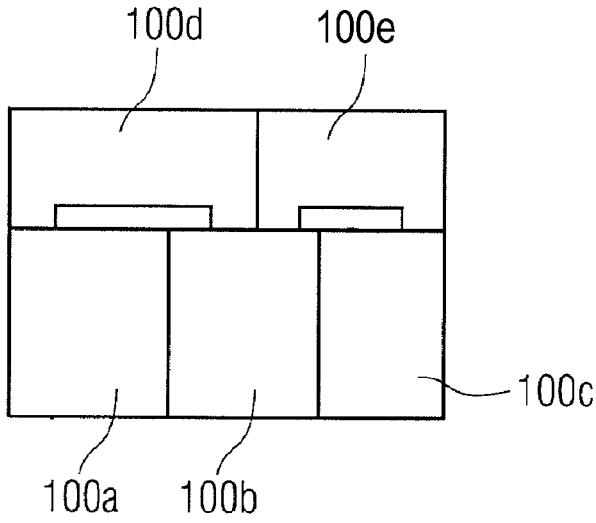
FIG 3

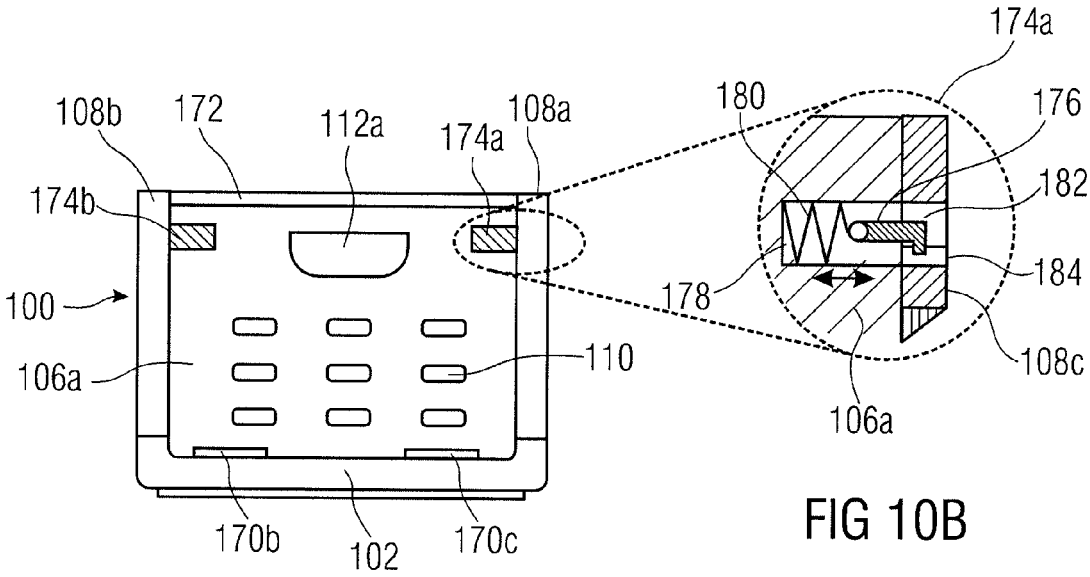
FIG 10A
FIG 10B
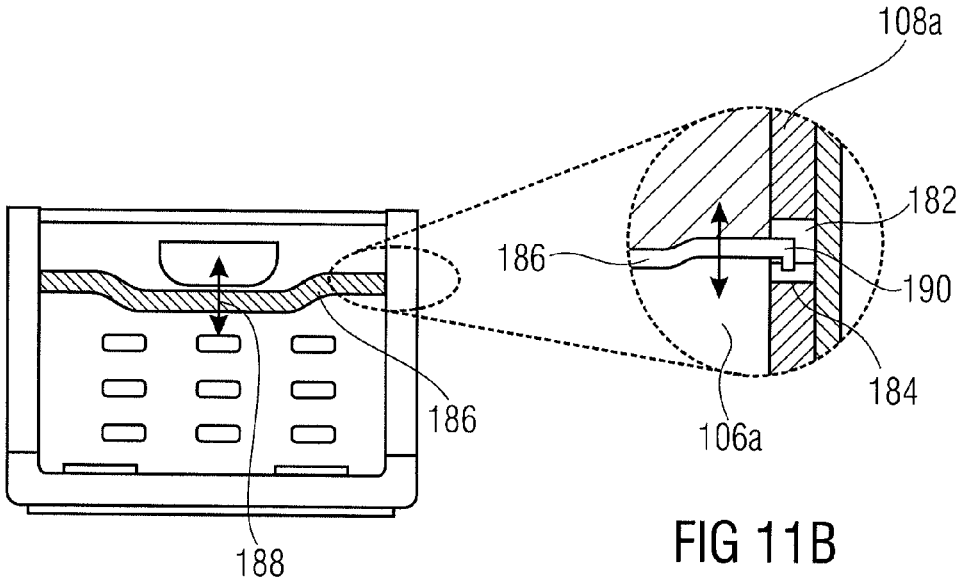
FIG 11A
FIG 11B

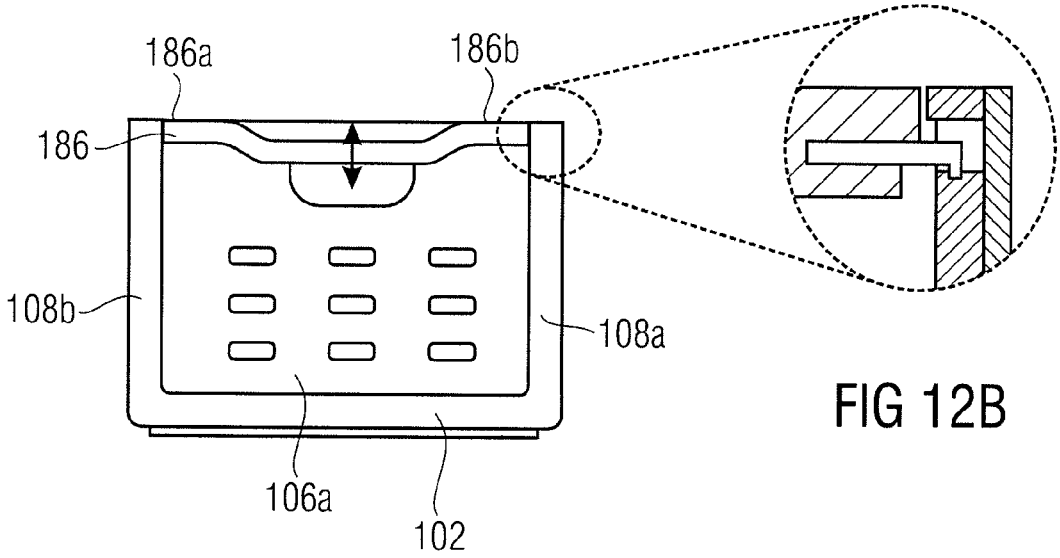
FIG 12B
FIG 12A
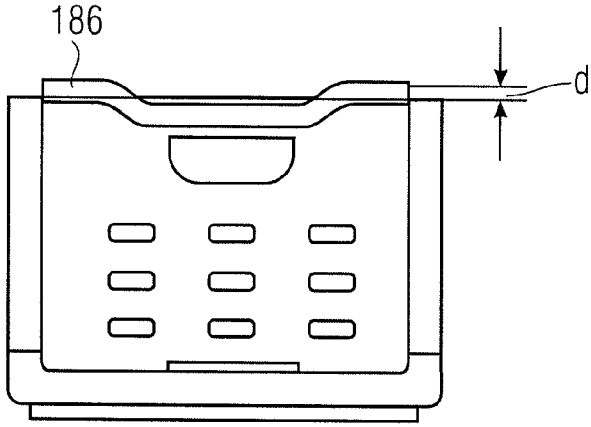
FIG 12C

CRATE

BACKGROUND OF THE INVENTION

Embodiments of the invention concern a crate or container for accommodating products, more specifically, embodiments of the invention concern a plastic crate that is provided for receiving and/or for transporting foods, like fruits, vegetables, meat and the like.

Crates for storing and transporting products such as fruits and vegetables are widely used in the market. Such crates are light and stable which makes them suitable for bringing the crops from the field to the customer. For example, for tropical fruits like bananas, it is common to harvest the crop while it is still unripe and pack it into the crates for subsequent shipping and transportation. On this journey, the fruits have time to ripen. Also, other fruits like apples or the like, or vegetables like lettuce or the like, but also meat or eggs may be put into the crates at the producers site and transported using such crates.

Before the transport, the filled crates are usually stacked on top of each other and arranged side by side on two pallets and the pallets, as a whole, are then transported to respective transport facilities. Often, a specific cross-stacking technique is used, for example, a "5-down configuration". In such a 5-down configuration, five crates are arranged adjacent to each other into a rectangular array, such that two of them form a row in the length direction and the other three form a row in the width direction. One problem with such kind of arrangement is that upon stacking the crates in this way, the three crates forming the row in the width direction abut with their shorter end walls the longer side walls of the two crates forming the row in the length direction. Thus, a force acting onto the lateral side walls of the crate arrangement in the length direction is high, especially in the central area of the side walls of the crates arranged in the length direction. This may result in a damaging of the crates during the transport or during stacking.

The above described crates may be plastic crates that comprise opposing end walls and opposing side walls extending from a bottom having a generally rectangular shape. The crates may also be formed from other materials, like wood, carton or the like. The crates may be so-called foldable crates, which means that the end walls and the side walls can be folded downward into the direction of the bottom. This allows the transport of empty crates in their folded state, for example to the fields, where the crop is harvested and directly put into the respective crates. This allows for shipping a high number of folded crates, using a minimum amount of transport capacity, thereby bringing the folded crates to the desired locations in an economical way. There are crates of different heights, i.e. some crates have walls extending from the bottom by a first distance, whereas others extend upward by a second distance that may be more than the first distance. The height of the crates, when being unfolded, depends on the products to be received therein and transported. The structure of the crate having the foldable walls may be such that the side walls when being folded downward onto the bottom may overlap. In such a case, to obtain a minimum possible height, conventional crates require a specific sequence of folding the respective wall portions. For example, first of all, the two end wall portions are to be folded onto the bottom and then a first of the two side walls is folded downward to rest on the folded-down end walls and then a second of the side walls is folded down afterwards. The respective side walls are configured in such a way that a minimum height of the folded crate is obtained without any parts extending beyond this height.

However, this approach is disadvantageous as it requires the user of a crate to be aware of how the crate is to be folded, i.e., the respective wall portions need to be folded in the correct way, otherwise the minimum height is not obtained and, in addition, elements of the wall portions may extend beyond the minimum height, thereby avoiding proper stacking of the folded crates. One solution to this problem is to provide a projection on the edge of the bottom extending upwardly from the bottom by a predefined distance, thereby ensuring that independent of the way the two side walls are folded, even in the "worst case", none of the parts of the side walls extend above the upper end of the projection. While this solves the problem regarding parts extending beyond the height of the folded crate, it increases, at the same time, the height of the folded crate and thereby limits the overall number of folded crates that can be stacked and shipped. While this may seem a minor problem when looking only at a single crate, one has to consider the situation that a high number of such crates is folded and shipped by being placed on respective pallets and the projection having the increased height as mentioned above, may result in a loss of transport capacity of about 15%.

The crates described above, which are foldable, further comprise a locking mechanism that ensures a secure connection of the side walls and the end walls in the unfolded state of the crate. At the same time, an easy to handle mechanism must be provided for releasing the latch when it is desired to fold the crate after all products have been removed and the crate is to be shipped back to the supplier, for example, for cleaning. Crates having foldable walls therefore comprise release mechanisms that act onto the latch elements provided for releasing the latch and thereby allowing folding downward the respective side walls. For example, the side walls may comprise respective receptacles formed at a lateral edge thereof, a lateral edge is being adjacent to the end walls. In the end walls movable latch mechanisms may be provided, for example, a hook that is biased into a downward direction and engages with the receptacle in the side wall upon bringing the respective walls into their upright position. For example, when moving a side wall from the bottom position to the upright position, the hook is lifted upon passing the elements of the side wall and then, due to the downward bias, the hook is received in the receptacle. For releasing the latch by means of the release mechanism, the hook is lifted, so that the latch elements are disengaged and the side wall can be folded downward into the direction of the bottom again.

These mechanisms provide an easy to handle way for unfolding the crate, however, the mechanisms, in general, are provided such that same can be actuated any time the crate is in the unfolded state. This is disadvantageous as it also allows actuating the release mechanism when a plurality of crates are stacked, for example on a pallet. In such a situation due to a shock or to an erroneous handling a latch mechanism of one or more of the crates inside the stack may be actuated, thereby unlocking the respective wall element, making the stack as a whole unstable. In the worst case, this may result in the collapse of the stack because one or more of the crates inside the stack may no longer provide the required stability for supporting the crates stacked on top thereof.

As mentioned above, the crates may be used for transporting foods, like vegetables, fruits and meat or the like. These products may require cooling and it is therefore desired to provide to the interior of the crate a cooling liquid, like ice-water or the like ensuring that the goods stay fresh and/or at a desired temperature. While the crates, in general, have openings in the side walls and the bottom for allowing the circulation of air, these openings may not be sufficient to allow a sufficient flow of cooling liquid into the interior of the crate, for example, when using ice-water, it may well be that ice particles are within the fluid stream which cannot pass the holes provided for air ventilation and, that may actually block the holes, thereby avoiding that the liquid reaches the interior of the crate.

SUMMARY OF THE INVENTION

Embodiments of the invention provide an improved crate overcoming one or more of the problems of conventional crates described above.

In accordance with the first aspect, embodiments of the invention provide a crate including a bottom, two end walls, and two side walls. Each of the side walls includes a first lateral edge adjacent to the first end wall, a second lateral edge adjacent to the second end wall, a lower edge adjacent to the bottom, and an upper edge distant from the bottom. Each side wall includes a continuous stiffening member extending parallel to the lateral edges and at least partly to the upper edge. The continuous stiffening member includes a stiffening portion extending at least in one area between the lateral edges from the upper edge in the direction towards the lower edge and back to the upper edge.

In accordance with embodiments the stiffening portion is U-shaped and extends in a central area of a side wall towards the lower edge. In embodiments of the invention, the stiffening portion extends towards the lower edge such that a distance to the lower edge is smaller than or equal to half the height of the side wall. Alternatively, the stiffening member may extend to the lower edge of the side wall.

Embodiments may include a continuous stiffening member having a plurality of stiffening portions extending towards the lower edge of the side wall. In such embodiments, the plurality of stiffening members may have the same or different distances to the lower edge of the side wall.

Embodiments of the invention may provide a crate that is made of plastic and the continuous stiffening member may be formed by water injection molding. The crate may be foldable such that the end walls and the side walls can be folded with respect to the bottom.

Embodiments of the invention in accordance with a second aspect provide a crate including a bottom having two projections arranged at opposite length sides and extending upward from the bottom, to opposing end walls extending along width sides of the bottom, and two opposing side walls extending along the length sides of the bottom. The end walls and the side walls are configured to be foldable with respect to the bottom. The side walls have a height such that the side walls at least partially overlap when being folded. Each side wall is coupled to the bottom via at least one hinge, and each hinge is provided slidably in the projection such that the hinge is movable between a lower end of a projection adjacent to the bottom and an upper end of the projection.

In accordance with embodiments the height of the projection above the bottom corresponds substantially to the thickness of the two side walls. In accordance with embodiments, in the unfolded state, the lower ends of the side walls rest on an upper surface of the respective projections with the hinges for both side walls at a lower position close to the bottom, and in the folded state, the lower ends of the side walls are opposite to the inner surfaces of the respective projections with the hinges of the side walls at different heights in the projection, wherein one side wall rests on the end walls folded onto the bottom, and the other side wall, at least in part, rests on the one side wall.

In accordance with embodiments the hinge of the one side wall resting on the end walls remains at the lower position, and the hinge of the other side wall is in a position above the lower position, thereby allowing the arrangement of the folded side walls to be substantially parallel to the bottom, wherein an outer surface of the other side wall is substantially on the same level as the upper surface of the projections.

In accordance with embodiments the hinges may be configured such that in the folded state there is a gap between the lower surface of the side walls and the respective inner surfaces of the projections. The hinge may comprise an extension rod connecting the hinge element in the projection and the side wall. The extension rod defines the gap and has a length defined by the distance between the lower portion of the hinge and the height of the projection. Each side wall may include a plurality of hinges.

Embodiments of the invention in accordance with a third aspect provide a crate including a bottom, two end walls, and two side walls. The end walls and the side walls are configured to be foldable with respect to the bottom. The end walls and the side walls comprise respective latch elements engaging with each other to form a latch when the end walls and the side walls are in the unfolded state. A latch release mechanism is provided at the respective end walls or at the respective side walls, wherein the latch release mechanism and/or the latch elements on the respective walls are configured to be movable so as to extend above an upper edge of the respective wall for releasing the latch.

Embodiments provide a latch release mechanism that includes a lift bar having opposite ends connected to the latch elements of one of the walls and having a shape that at least a part of the latch release mechanism extends above the upper edge of the wall when being in a releasing position.

In accordance with other embodiments one of the engaging latch members is movable and one is stationary, wherein the movable latch member is configured to extend above the upper edge of the wall when being in a position releasing the stationary edge element. The movable latch element, when in the releasing position, may be configured to be folded together with a wall being moved towards the bottom.

In accordance with a fourth aspect embodiments of the invention provide a crate including a bottom, two end walls, and two side walls. At least one of the end and side walls comprises an inlet having a dimension allowing to introduce a predefined amount of cooling liquid into the interior of the crate.

In accordance with embodiments, at least two opposing walls may comprise a plurality of inlets, for example each side wall may comprise a plurality of inlets. In accordance with embodiments, each side wall includes first and second lateral edges adjacent to respective end walls, a lower edge adjacent to the bottom and an upper edge distant from the bottom. A first inlet is arranged adjacent a first upper corner of the side wall adjacent to the first lateral edge and the upper edge, and a second inlet is arranged adjacent a second upper corner of a side wall adjacent to the second lateral edge and the upper edge.

Other embodiments provide side walls having a continuous stiffening member extending parallel to the first and second lateral edges and parallel to the upper edge with a U-shaped portion in a central area extending toward the lower edge. A first inlet is provided at the left portion of the side wall at a distance from the lower edge with a part of the continuous stiffening member between the second inlet and the first lateral edge, the upper edge and the central area. A second inlet is provided at the right portion of the side wall at a distance from the lower edge with a part of the continuous stiffening member between the second inlet and the second lateral edge, the upper edge and the central area.

In accordance with embodiments, in the central area of the side wall a third inlet may be provided at a distance from the upper edge and with a part of the continuous stiffening member between the third inlet and the lower edge, the left portion and the right portion. The third inlet may have a dimension that is smaller than the dimension of the first and second inlet. The inlets may be provided with a lattice having a mesh size allowing the passage of a liquid, for example, ice-water having ice particles therein.

Embodiments of the invention in accordance with the first to fourth aspect may provide crates that are formed of plastic and that are provided for receiving and/or transporting foods, like fruits, vegetables, meat and the like.

BRIEF DESCRIPTION OF THE DRAWINGS

Embodiments of the invention will be described with reference to the accompanying drawing, in which:

FIGS. 2A and 2B are side views of the crate of FIG. 1;

FIG. 3 is a schematic representation of one layer of a stack of crates provided in the 5-down configuration;

FIGS. 10A and 10B show an example of a conventional latch mechanism, wherein FIG. 10A shows the first side wall of the crate, and FIG. 10B shows an example of the latch mechanism in an enlarged view;

FIGS. 11A ad 11B shows a further example of a conventional latch mechanism, wherein FIG. 11A shows a similar arrangement as in FIG. 10A, and FIG. 11B shows an enlarged view of the latching mechanism in accordance with this example;

FIGS. 12A-12C show the locking mechanism in accordance with an embodiment of the invention;

DESCRIPTION OF EMBODIMENTS OF THE INVENTION

In the following description different aspects of a crate will be described, namely the aspect of providing an additional central stiffing element for avoiding damages of the side walls of a crate, the aspect of providing movable hinges of foldable side walls allowing the folding of the side walls of a crate, which are overlapping in the folded state in an arbitrary manner, the aspect providing a latch mechanism/latch release mechanism, avoiding unintentional opening of the latch of stacked crates, and the aspect of providing an inlet for introducing cooling liquid, like ice-water into the interior of the crate. However, first of all, elements of the crate being common to all aspects will be described with regard to FIG. 1 below.

Figure 1:
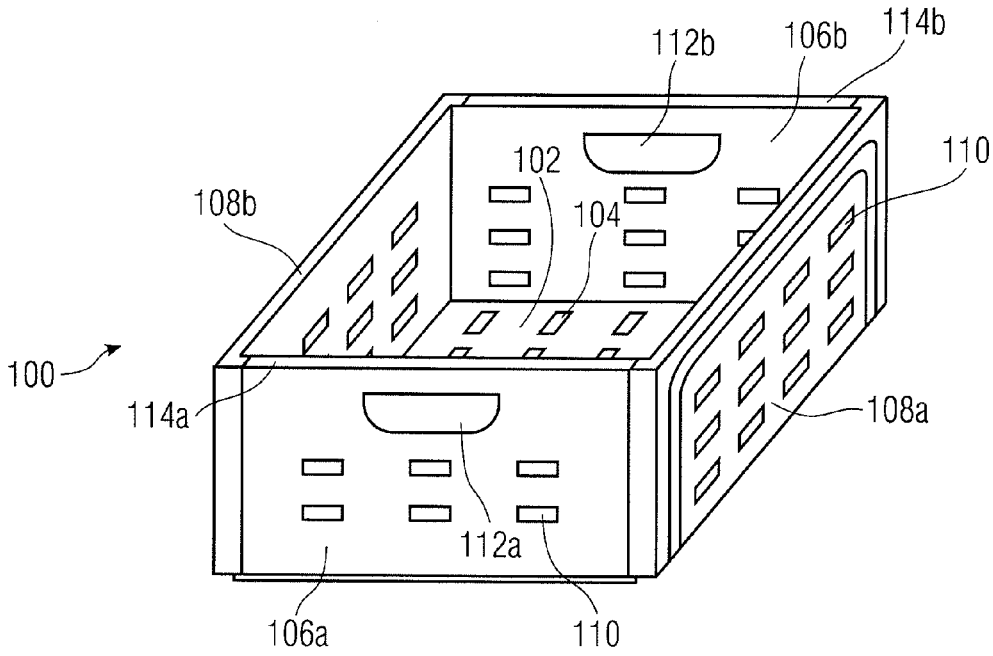
FIG. 1 is a perspective view of a crate.

FIG. 1 is a perspective view of the crate 100 comprising a bottom 102 that may comprise a plurality of openings 104. The crate 100 further comprises a first end wall 106*a* and a second end wall 106*b* being opposed to the first end wall 106*a*. Further, two opposing side walls 108*a* and 108*b* are provided opposite to each other. As can be seen, the side walls 108*a* and 108*b* are longer than the end walls 106*a* and 106*b*. In accordance with embodiments of the invention the side walls and end walls may be foldable towards the bottom 102 such that, for example, first of all the end walls 106*a* and 106*b* are folded onto the bottom and then the side walls 108*a* and 108*b* are folded towards the bottom. The dimension of the side walls in the height direction may be such that upon folding same towards the bottom, the side walls may overlap. The advantage of folding the side walls and end walls towards the bottom is that the remaining volume of the crate is minimal, so that in the folded state the crate occupies only a low height, so that a large number of empty crates may be stacked, for example onto a single pallet for transport. In accordance with embodiments of the invention, the crate is made of plastic, thereby providing a low weight and a high stability for storage and/or transport applications. Besides the holes 104 in the bottom 102 also holes 110 are formed in the respective walls and may provide vent holes. Further, larger holes 112*a* and 112*b* are provided in the upper part of the end walls 106*a* and 106*b*, the holes 112*a* and 112*b* defining grip holes. As can be seen, an upper edge 114*a* and 114*b* of the end walls may have an increased thickness thereby ensuring that carrying the crate when griping the grip holes 112*a* and 112*b* is secure and that a sufficient strength of the portion of the end wall above the grip holes is provided.

First Aspect—"Central Stiffening Portion"

In the following embodiments of the invention according to a first aspect will be described. FIG. 2 shows a side view of the crate 100. In FIG. 2(*a*) the first side face 108*a* is shown that extends upward from the bottom 102. As mentioned above, in case the crate is a foldable crate, FIG. 2(*a*) shows the side wall 108*a* in its upright position or unfolded position. Further, a plurality of vent holes 110 is shown. The side wall 108*a* comprises a stiffening member 116 having a first part extending parallel to a first lateral edge 118 of the side wall 108*a*. The lateral edge 118 is, for example, adjacent to the first end face 106*a* shown in FIG. 1. The stiffening member 116 also extends parallel to a second lateral edge 120 of the side wall 108*a* wherein the second lateral edge 120 is adjacent to the second end wall 106*b*. The stiffening member further extends parallel to an upper edge 122 of the side wall 108*a* wherein the upper edge 122 is distant from a lower edge 124 that, in turn, is adjacent to the bottom 102. As is shown in FIG. 2(*a*), the stiffening member 116 is a continuous stiffening member that is, for example, obtained during molding the plastic side wall 108*a*, using the water injection molding process. The continuous stiffening member 106 extends, as mentioned above, parallel and adjacent to the first lateral edge, the upper edge and the second lateral edge in a manner as shown in FIG. 1, and the vent holes 110 are provided in an area of the side wall 108*a* that is surrounded by the stiffening member 116 and the lower edge 124.

FIG. 2(*b*) shows a cross-sectional view of the side wall 108*a* along the line b-b'. As can be seen, the stiffening member 116 has a hollow structure with a cavity 116*a* there between that is formed by the water injection molding process and provides for a member having a high stiffness with a reduced amount of material and thereby also with a reduced amount of weight.

The side wall structure shown in FIG. 2(*a*) is disadvantageous in situations where a plurality of crates are stacked in the above-mentioned 5-down configuration. FIG. 3 is a schematic representation of one layer of a stack of crates provided in the 5-down configuration. As can be seen, three crates 100*a*-100*c* are arranged side by side, i.e. side walls of the crates 100*a*-100*c* are adjacent. In addition, two further crates 100*d* and 100*e* are arranged adjacent to the end walls of the crates 100*a*-100*c* such that two end walls of the crates 100*d* and 100*e* are adjacent. Thus, as can be seen from FIG. 3, the shorter end walls of crates 100*a*-100*c* abut the longer side walls of the crates 100*d* and 100*e*, resulting in the above-mentioned problem that a force that acts onto the side walls of the crates 100*d* and 100*e* is high in a central part of the side wall and may result in damaging the crates 100*d* and 100*e* in case of a movement of one or more of the crates 100*a*-100*c* due to a shock or the like. For example, upon stacking first the crates 100*e* and 100*d* are provided and then the further crates 100*a*-100*c* are added and during the arrangement of the additional crates 100*a*-100*c* they may impact onto the side walls of the crates 100*d* and 100*e*, resulting in a possible damaging of the side walls.

Thus, the stiffening structure of the side wall of the crate shown in FIG. 2(*a*) which works fine when the crates are arranged parallel to each other like the crates 100*a*-100*c* is disadvantageous in case of an arrangement of the crates as shown in FIG. 3.

Figure 4:
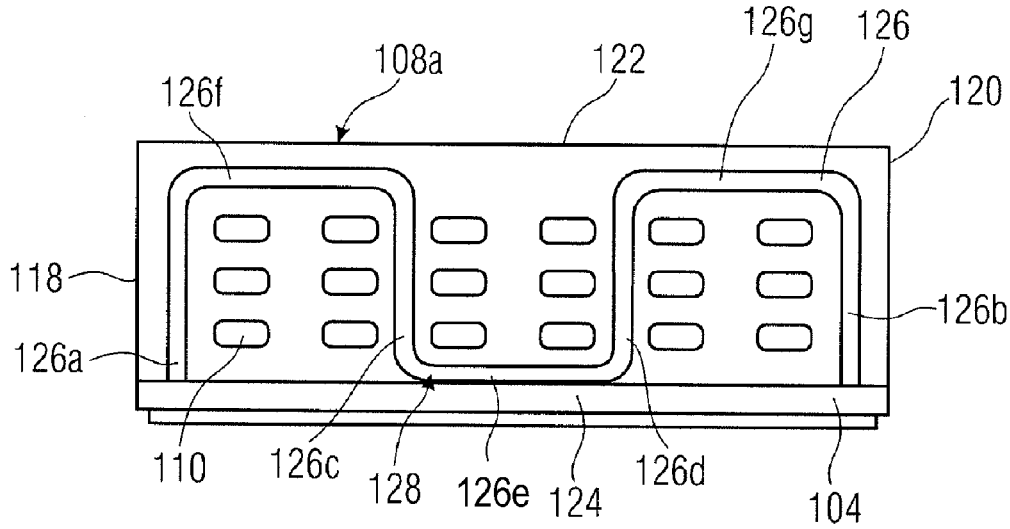
FIG. 4 shows an embodiment a side wall of a crate having a modified stiffening member.

Thus, in accordance with embodiments of the invention concerning the first aspect, a modified stiffening member is provided. FIG. 4 shows an embodiment of such a modified stiffening member. FIG. 4 shows the side wall 108*a* having the modified stiffening member 126. Again, the stiffening member 126 has a first part 126*a* extending parallel and adjacent to the first lateral edge 118. A second part 126*b* of the modified stiffening member 126 extends parallel and adjacent to the second lateral edge. The modified stiffening member 126 is also a continuous stiffening member extending continuously from the lower left-hand corner of the side wall 108*a* along the lateral edge 118 and along the upper edge towards the second lateral edge and downward to the lower right-hand corner of the side wall 108*a*. The modified stiffening member 126 further comprises in a central area of the side wall 108*a* a U-shaped portion 128. The U-shaped portion 128 comprises two vertical stiffening member parts 126*c* and 126*d*, being substantially parallel to the parts 126*a* and 126*b*. Further, a part 126*e* is provided adjacent to the lower edge 124. In the left and right portions outside the central portion of the side wall 108*a* the modified stiffening member 126 comprises the parts 126*f* and 126*g* being arranged adjacent to the upper edge 122. As mentioned above, the modified stiffening member 126 is a continuous member, i.e. all parts 126*a*-126*e* are connected with each other, thereby forming the continuous member in a way as shown in FIG. 4. The vent holes 110 are provided in the left and right portions of the side wall with the stiffening member being provided between the vent holes and the lateral edges 118 and 120, respectively, the central area and the upper edge 122. In the central area the vent holes are provided with a stiffening member between the left and right portions and the lower edge 124.

The arrangement of FIG. 4 provides for an increased stiffness of the side wall 108*a* and the central part, thereby avoiding damages in situations as described above when the plurality of crates are stacked in a 5-down configuration shown in FIG. 3.

Figure 5A:
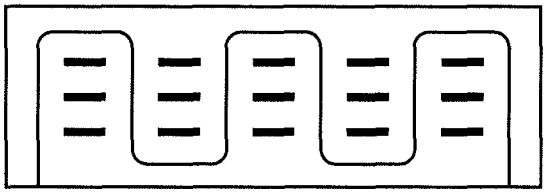
FIGS. 5A to 5C show different configurations of the modified stiffening member of FIG. 4.
Figure 5B:
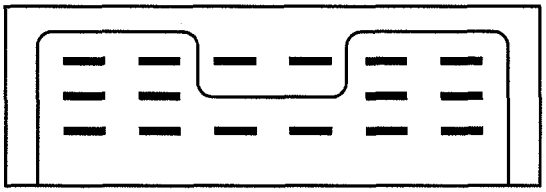
Figure 5C:
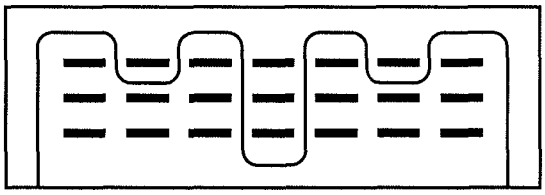

Embodiments of the first aspect are not limited to the configuration shown in FIG. 4, rather different configurations of the modified stiffening member 126 may be provided. Such embodiments are now described with regard to FIGS. 5(*a*) to (*c*). The respective figures show schematically the side wall 108*a* also described with regard to FIG. 4 with respective modified stiffening members 126. In embodiment shown in FIG. 5(*a*) the side wall comprises two U-shaped portions of the modified stiffening member, both of which extend all the way towards the lower edge. FIG. 5(*b*) shows a schematic representation of a different embodiment in accordance with which the U-shaped portion of the stiffening member only extends half the height of the side wall 108*a* down towards the lower edge. FIG. 5(*c*) shows a schematic representation of yet another embodiment using three U-shaped stiffening member portions with different "depths", i.e., extending by different amounts toward the lower edge of the side wall.

While embodiments described above refer to U-shaped stiffening member portions extending towards the lower edge it is noted that the invention is not limited to such embodiments. Rather, in accordance with further embodiments, the portion of the stiffening member extending in an area of the side wall away from the lateral edges toward the bottom may be different, for example the portion may be V-shaped or may have, if desired, also an unsymmetrical shape.

Second Aspect—"Movable Hinges"

In the following, embodiments of the invention in accordance with a second aspect will be described. The second aspect concerns the folding of side walls of the crate which, when being folded down onto the bottom overlap each other. As mentioned above, the order of folding down the side walls in accordance with the conventional crates needs to be observed so as to correctly fold the crate to obtain a minimum remaining volume of the folded crate.

Figure 6:
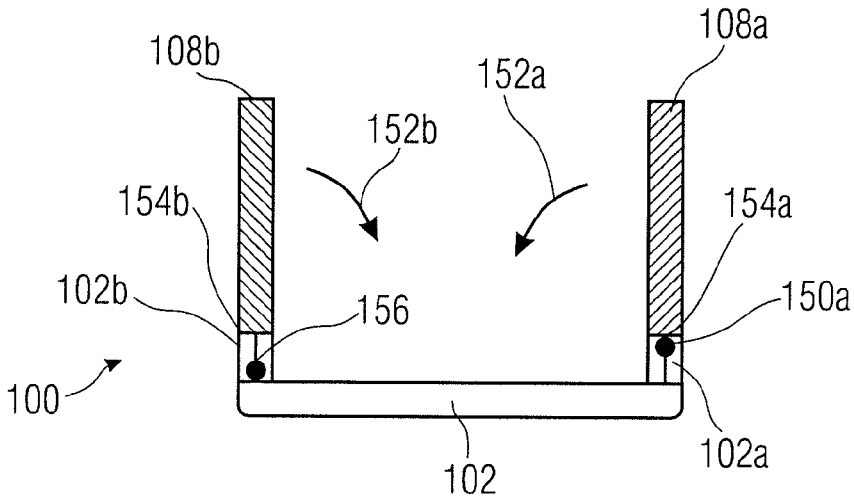
FIG. 6 is a cross-sectional view of a crate taken at a central position of the crate shown in FIG. 1.

FIG. 6 shows a cross-sectional view of a crate, wherein this cross-sectional view is taken at a central position of the crate shown, for example, in FIG. 1. The crate 100 shown in FIG. 6 comprises the bottom 102 and the side walls 108*a* and 108*b*. The bottom 102 comprises projections 102*a* and 102*b* that extend upward from the bottom 102. The projections 102*a* and 102*b* are at the outer edges of the bottom 102 and may be integral with the bottom 102. The first projection 102*a* comprises a first hinge 150*a* that is shown schematically in FIG. 6. The first hinge 150*a* provides for a connection between the projection 102*a* and the first side wall 108*a* in such a manner that the side wall can be rotated in a direction as indicated by arrow 152*a*. As is known from conventional crates, means may be provided to allow a movement of the side wall 108*a* only from a position folded down onto the bottom 102 up to a vertical position as it is shown in FIG. 6 such that a lower surface 154*a* on the side wall 100*a* is arranged adjacent or at an upper surface of the projection 102*a*. In a similar manner, a second hinge 150*b* is provided in a second projection 102*b*, however, as can be seen from FIG. 4, the hinges 150*a* and 150*b* are arranged at different heights with respect to the bottom 102. The hinge 150*b* is connected by a connecting rod 156, to the side wall 100*b* that same may be rotated in the direction of arrow 152*b* towards the bottom 102.

Figure 7A:
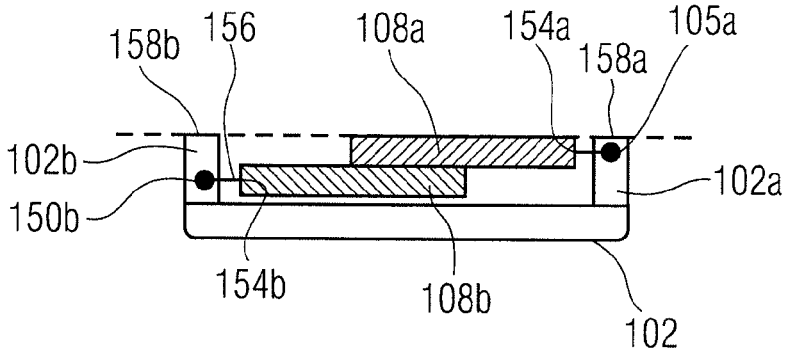
FIGS. 7A and 7B show a correct (FIG. 7A) and an incorrect (FIG. 7B) folding of the crate shown in FIG. 6.
Figure 7B:
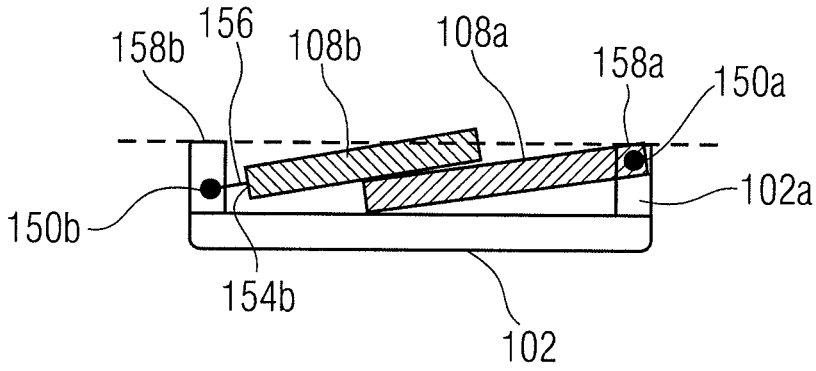

In accordance with a crate having a structure as it is shown in FIG. 6, it is required that the side walls 108*a* and 108*b* are folded down in the correct order to ensure a minimum volume of the folded crate. FIG. 7 shows a correct and an incorrect folding of the crate shown in FIG. 6. In accordance with the crate shown in FIG. 6 to be correctly folded it is required to first of all to fold down side wall 108*b*, so that same comes to rest adjacent to the bottom 102. Then the second wall 108*a* is folded down. When observing this correct order, the outer surface of the side wall 108*a* will be substantially at the same height from the bottom 102 as the upper surfaces 158*a* and 158*b* of the projections 102 *a* and 102*b*. The side walls 108*a* and 108*b* are arranged such that their lower surfaces 154*a* and 154*b* are adjacent to inner side walls of the projections 102*a* and 102*b*. As can be seen from FIG. 7(*a*) observing the correct folding order results in a folded crate having a minimum volume.

However, when the folding order described with regard to FIG. 7(*a*) is not observed, a result is achieved as it is shown in FIG. 7(*b*). As can be seen, when folding down the side wall 108(*a*) first, it is arranged only over the front part or upper part thereof adjacent to the bottom 102 while the second surface 108*b* rests on the first surface 108*a* in such a manner that at least partially the outer wall of the second side wall 108*b* is above a level of the upper surfaces 158*a* and 158*b* of the projections 102*a* and 102*b*.

Thus, stacking the folded crate is not possible as the entire stack will become instable. Therefore, a conventional solution to this problem is to provide the projections 102*a* and 102*b* with a height such that independent from the order of folding the side walls 108*a* and 108*b*, a top level of the folded down side walls corresponds substantially to the height of the upper surfaces of the projections 102*a* and 102*b*. While this solves the problem of possible instable stacks of folded crates, at the same time, it reduces the number of folded crates that can be stacked as the minimum volume of the folded down crates is increased. In accordance with the investigations of the inventors of the invention, it was found out that the increase in minimum volume may be such that the entire amount of crates that may be transported on a common pallet may be reduced by as much as 15%, resulting in increased transport costs which is undesirable.

Figure 8:
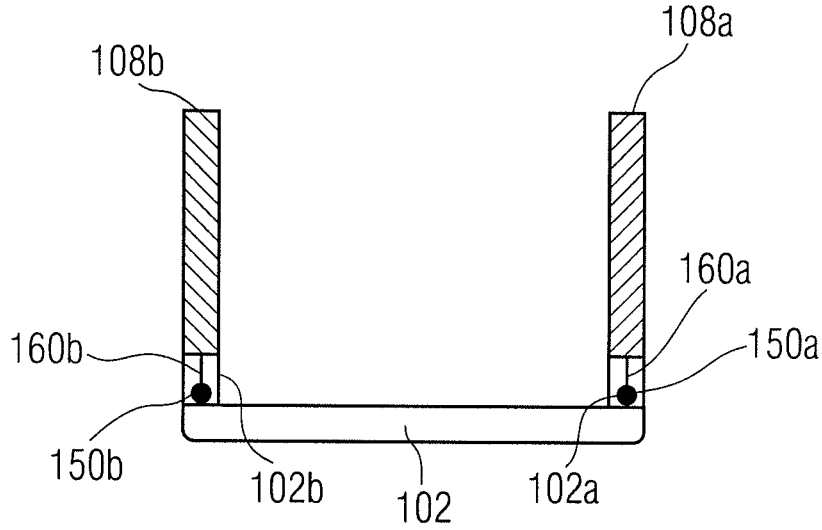
FIG. 8 shows a cross-sectional view similar to FIG. 6 illustrating the modified hinge structure in accordance with embodiments of the invention.

Therefore, in accordance with embodiments of the invention the hinge structure of the crate is modified in a manner as described in further detail below. FIG. 8 shows a cross-sectional view similar to FIG. 6, however, illustrating the modified hinge structure. Again, the bottom 102 and the projections 102*a* and 102*b* are shown as well as the side walls 108*a* and 108*b*. In the projections 102*a* and 102*b*, the hinges 150*a* and 150*b* are provided, however, each of the hinge is arranged movably within a recess in the projection 102*a* and 102*b* and is connected with respective rods 160*a*, 160*b* to the respective side alls 108*a* and 108*b*. In the position shown in FIG. 8, the side walls are folded up and are in the vertical position such that their lower surfaces are adjacent to upper surfaces of the projections. The position of the hinge 150*b* is substantially the same as the position of the hinge in FIG. 6, however, the position of the hinge 150*a* is at the same level as hinge 150*b*, whereas in FIG. 6 the two hinges were at different levels.

Figure 9A:
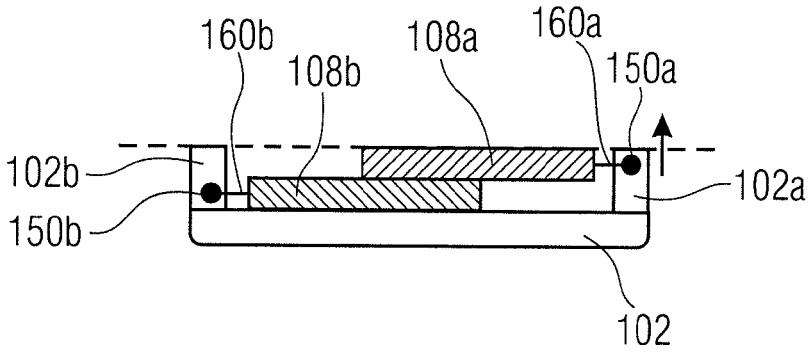
FIGS. 9A and 9B show the situation when the crate of FIG. 8 is folded down either with the side wall 108*b* folded first (FIG. 9A) or the side wall 108*a* folded first (FIG. 9B)
Figure 9B:
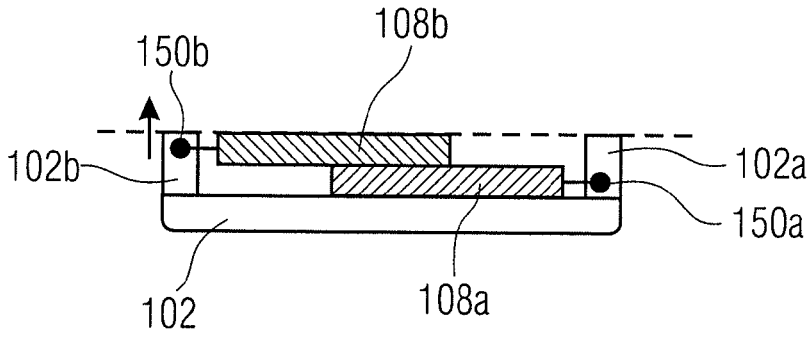

When folding the crate as it is shown in FIG. 8, it is irrelevant whether first of all side wall 108*a* and then side wall 108*b* is folded down or vice versa. FIG. 9 shows the situation when the crate of FIG. 8 is folded down either with the side wall 108*b* folded first or the side wall 108*a* folded first. In FIG. 9(*a*) it can be seen that the second side wall 108*b* was folded first, so that it is arranged adjacent to the bottom 102. In this situation, the hinge 150*b* remains substantially at the position as it is shown in FIG. 8 and a gap between the lower surface of the side wall 108*b* and the inner side wall of the projection 102*b* is determined by the length of the rod 160*b*. On the other hand, hinge 150*a* is moved from the position shown in FIG. 8 to an upward position allowing the first side wall 108*a* to rest on the second side wall 108*b* in such a manner that the level of the outer surface of the side wall 108*a* corresponds substantially to the upper surface of the projections 102*a* and 102*b*.

FIG. 9(*b*) shows a similar arrangement, however, with the first side wall 108*a* being folded down first, so that a hinge 150*a* remains at the position as it is in FIG. 8. As explained with regard to FIG. 7(*a*) in this case, the hinge 150*b* of the second side wall 108*b* is allowed to move upwards so that in this case the outer surface of the side wall 108*b* is at a level corresponding substantially to an upper surface of the projection 102*a* and 102*b*. By allowing the respective hinges to be movable, a situation as it is shown in FIG. 7(*b*) is avoided as can be seen from FIG. 9(*b*). Thus, in accordance with embodiments of the invention it is not necessary to increase the height of the projections, rather by the arrangement in accordance with embodiments of the invention, the upper level of the folded-down side walls is always substantially the same as the upper surface of the projections 102*a* and 102*b* irrespective as to whether the first side wall 108*a* or the second side wall 108*b* is folded down first. By avoiding the increase in the height of the projections, the overall number of folded crates that may be transported on a pallet at the same time can be increased, so that the transport of the folded-down crates is more efficient than in conventional approaches.

In FIGS. 6 to 9, a cross-sectional view of the crate was shown without the end walls. However, it is noted that also the end walls need to be folded for obtaining a folded-down crate and, in accordance with embodiments, the end walls are folded down first, so that the side walls after being folded down are adjacent to the bottom, but rest at least partially on the folded-down end walls. There may be other embodiments in accordance with which the end walls are folded down only once the side walls were folded down and in this case, the principles of embodiments of the invention, described with regard to the second aspect apply as well.

Third Aspect—"Latch/Latch Release Mechanism"

In the following, embodiments of the invention in accordance with a third aspect will be described. Conventional foldable crates do have respective latch mechanisms that provide for a latching operation holding together the end walls and the side walls in their vertical position. An example of such a latch mechanism is the provision of a pair of movable latches in the end walls of a foldable crate which, in the vertical position, engage respective latch receiving elements that are provided in the adjacent side walls. Naturally, respective latches and latch receiving elements may be provided the other way around, i.e. the latches may be provided in the side walls and the latch receiving elements may be provided in the end walls.

FIG. 10 shows a first example of a conventional latch mechanism. In FIG. 10(*a*) the crate 100 shows the first side wall 106*a* having the plurality of vent openings 110. By means of end wall hinges 170*a* and 170*b*, end wall 106*a* is rotatably mounted to the bottom 102, allowing the end wall 106*a* to be rotated towards the bottom when being folded down. Further, the side walls 108*a* and 108*b* are shown. In the portion above the grip hole 112*a* the upper part 172 of the side wall 106*a* is shown as being enforced so that when carrying the crate sufficient rigidity and strength is ensured and breaking of the upper part above the grip hole 112*a* is avoided. Further, two latch mechanisms 174*a* and 174*b* are provided in the end wall. FIG. 10(*b*) shows an example of the latch mechanism 174*a* in an enlarged view. In this example, a latch 176 is mounted in a recess 178 in the end wall 106*a*. The latch 176 is biased into an outward direction by a spring member 180 also provided in the recess 178. In the side wall 108*a* a recess 182 is provided for receiving the latch 176 in such a manner that a latching between the side wall and the end wall is achieved. For releasing the latching mechanism, an appropriate actuating element is provided in the latch mechanism 174*a* that allows moving the latch 176 inward, i.e. into a direction away from the side wall 108*a*, thereby disengaging the latch 176 with a latch receiving or counter element 184 provided in the recess 182. Once a latch was released the end wall may be folded downward onto the bottom and, following this, the side wall may also be folded down.

FIG. 11 shows a further example of a conventional latch mechanism. In FIG. 11(*a*) a similar arrangement as shown in FIG. 10(*a*) is shown except that the latch mechanism is realized differently. The latch mechanism comprises a lift bar 186 that can be moved vertically as is shown by arrow 188. FIG. 11(*b*) shows an enlarged view of the latching mechanism in accordance with this example. As can be seen, the outer ends of the lift bar 186 are provided with a hook 190 or a latch that is received within the recess 182 of the side wall 108(*a*) and engages the latching counter element 184. The lift bar 186 is biased into a downward direction, so that when the side walls and end walls are in the vertical position, the hook is urged into the element 184, thereby securely latching the side walls and the end walls. For releasing the side walls and the end walls, the lift bar is lifted upwards, thereby disengaging the hook from the element 184 and allowing the end wall 106*a* to be moved or rotated downwardly onto the bottom.

While the latching mechanisms, in general, work fine and provide for a secure fastening of the respective wall portions when being in a vertical state, there is a drawback in that the latching mechanisms may be released also in cases when a plurality of crates are stacked on top of each other. This may result in the above-mentioned problems. For example, due to a shock or a mishandling of the crates when being stacked on a pallet the latching mechanism of one or more of such crates may be released, for example, by a shock that results in a movement of the latching elements in their releasing direction. This may result in a situation in which one or more crates within a stack of crates have non-latched walls, so that the structural integrity of the entire stack is jeopardized as one or more of the crates may collapse, so that further crates being stacked on top thereof will also fall down.

To avoid such situations, embodiments of the invention in accordance with the third aspect provide for a novel latch mechanism as it will be described below with regard to FIG. 12. FIG. 12 shows the locking mechanism in accordance with an embodiment of the invention. The mechanism shown in FIG. 12 is similar to the one shown in FIG. 11(*a*), except that the lift bar 186 is provided such that for releasing the latch or lock at least one part 186*a* and 186*b* must be moved so as to extend above the height of the crate or above an upper edge of the crate. In this case, the latching mechanism as it is shown in FIG. 12 may be similar to the one shown in FIG. 11(*b*), except that it is provided adjacent to an upper edge of the end wall 106*a* and the side wall 108*a*. FIG. 12(*a*) shows the crate with the lift bar 186 in the unlocked position and, as can be seen, the parts 186*a* and 186*b* extend above an upper edge of the crate by a distance d. This allows simple locking/unlocking of the crates. However, the latching mechanism needs to be moved above the height of the crate for being unlocked. This avoids problems when stacking a plurality of crates on top of each other.

Figure 13A:
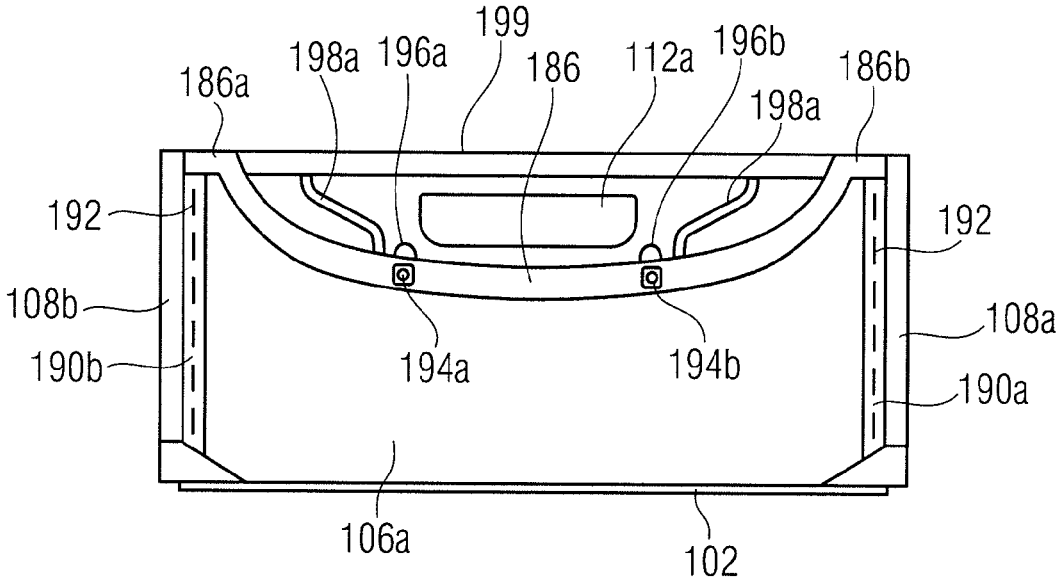
FIGS. 13A and 13B show the crate of FIGS. 12A-12C with the lift bar in the unlocked position.
Figure 13B:
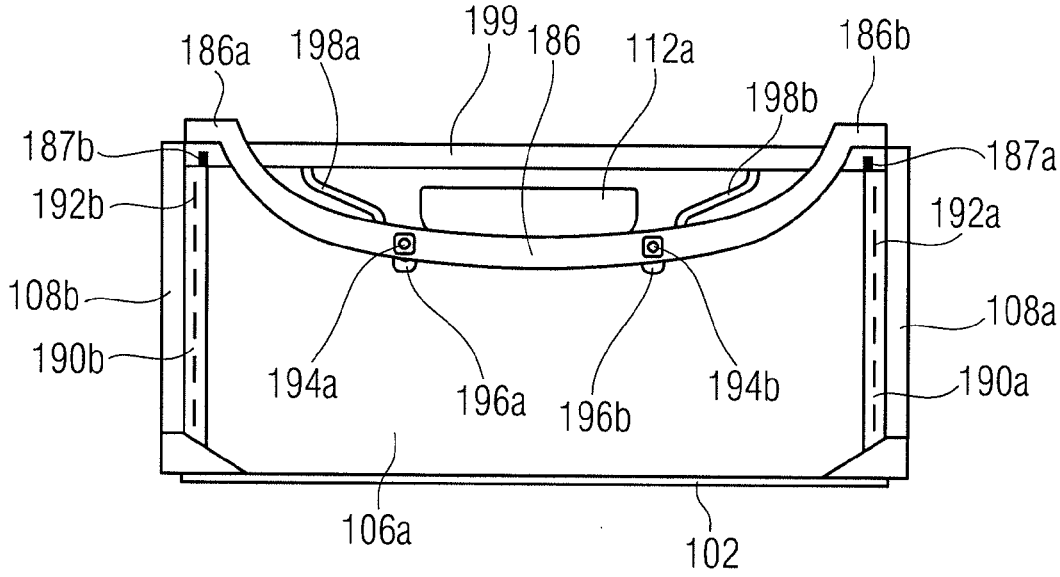

FIG. 13 shows a side view of a crate having a novel latch mechanism in accordance with another embodiment of the invention. FIG. 13(*a*) shows the crate with the latch mechanism blocking the side wall to the end wall whereas FIG. 13(*b*) shows the latch mechanism in the released position. To be more specific, in accordance with the embodiment of FIG. 13, like in the other embodiments, the crate comprises a bottom 102 and the end wall 106*a*. It is noted that the opposing end wall 106*b* has the same structure as the one shown in FIG. 13(*a*). Further, the two side walls 108*a* and 108*b* are shown. At the corner portions of the crate each side wall 108*a* and 108*b* comprises a protrusion 190*a* and 190*b* having a thickness corresponding to a thickness of the end wall 106*a*. The protrusions 190*a* and 190*b* may comprise a plurality of slits 192 that are provided by receiving protrusions provided on the front face of the side wall 106*a* for increasing the stability of the connection between the side wall and the end wall. The lift mechanism 186 is formed of an arch-shaped element having the end portions 186*a* and 186*b* being flush with an upper edge of the crate in the latched position. The lift mechanism 186 comprises two pins 194*a* and 194*b* that are extending towards the inside of the crate through slots 196*a* and 196*b* extending in a vertical direction and being provided in the end wall 106*a*. By means of the pins and slots 194 and 196, a defined movement of the lift mechanism 186 in a vertical direction is enabled while an undesired movement in a lateral direction is avoided. In addition, the lift mechanism comprises spring elements 198*a* and 198*b* having one end connected to the mechanism 106 and another end abutting a lower surface of a top bar 199 of the front wall or side wall 106*a*. The spring elements 198 abut against the bar 199 and need not to be fixed thereto, however, in embodiments also a connection to the bar 199 may be provided. The elements 198 are formed of the same material as the lift bar and the crate, for example a plastic material. Alternative embodiments may also use other spring elements formed from a different material like a metal or the like. The elements 198 bias the lift bar 196 into the position as shown in FIG. 13(*a*).

FIG. 13(*b*) shows the lift mechanism 186 in its unlocked position. As can be seen, the lift bar 108 was moved against the bias force of the spring elements 190*a* and 190*b* into a position that is closer to the bar 199 than in the locked position shown in FIG. 13(*a*). Moving the mechanism 186 in this direction results in a deflection of the elements 198 so that when releasing the lift mechanism 186, it is urged backward into the position shown in FIG. 13(*a*). As can be seen from FIG. 13(*b*), the lifting of the element 186 results in a lifting of the end portions 186*a* and 186*b* so that the element 186*a* and 186*b* are released from respective lock pins 187*a* and 187*b* arranged on a top surface of the protrusions 192*a* and 192*b* which are engaged by a respective opening or a recess in the elements 186*a* and 186*b* for locking the end wall and the side walls to each other.

In the position as shown in FIG. 13(*b*), the locking mechanism is released thereby allowing the end wall to be folded downwards onto the bottom and following this the side walls may be folded downward to the bottom.

As can be seen from FIG. 13(*b*) as in the embodiment described with regard to FIG. 12, also here the elements 186*a* and 186*b* are moved above the upper edge of the crate so that the mechanism 186 cannot be actuated and provided into the position shown in FIG. 13(*b*) when one or more other crates are stacked on top of the crate shown in FIG. 13(*b*).

Another advantage of the solution described with regard to embodiments of the invention concerning the locking mechanism is that it is not necessary to provide an expensive material to form the resilient members 198*a* and 198*b*, rather in accordance with the embodiments the same material can be used from which the crate as a whole is formed, for example, the same plastic material. Conventional approaches suffer from the disadvantage that the same material is used to form the crate and the resilient members, for example a plastic material. During the lifetime of the crate the spring member (the material from which it is formed) may loose all or part of its resilient characteristic. In such a situation the force to maintain/bias the lift mechanism into the position shown in FIG. 13(*a*) is lost or reduced. The increases the danger of releasing the lock even in case small forces were applied to the crate. In accordance with the embodiments of the invention such problems are avoided as in case the crate is provide in a stack with other crates on top (as is the usual way the filled crates are transported) maintaining the lift bar in the locked position is not only effected by the bias force being directed downward but also due to the structure requiring the lift bar to extend above the upper edge to release the lock.

Thus, even in case the resilient member should loose its resilient characteristics an undesired opening of the mechanism is avoided as in the stack the lift bar cannot be moved above the upper edge of the crate thereby not allowing opening of the lock mechanism.

Figure 14:
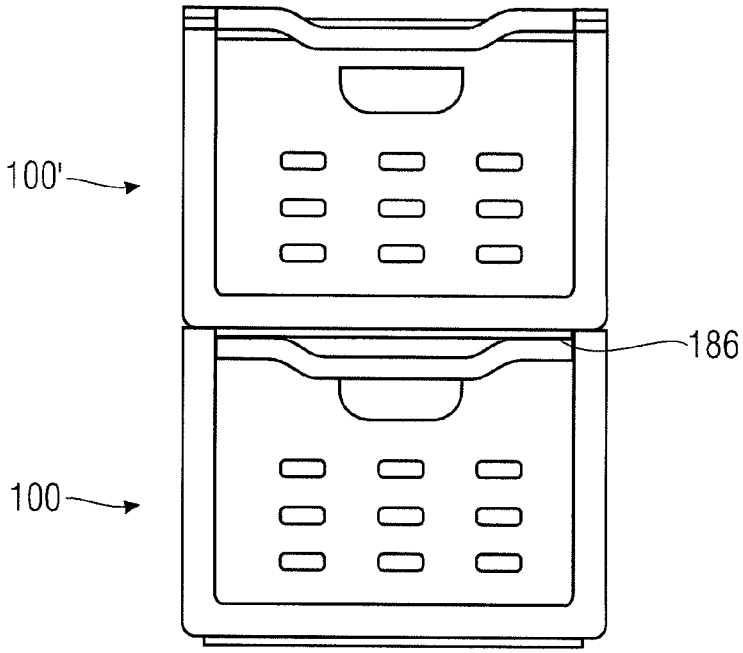
FIG. 14 shows an example of two crates stacked on top of each other.

FIG. 14 shows an example in which two crates 100 and 100' are stacked on top of each other. As can be seen from FIG. 14, due to the stacking a movement of the lift bar 106 in the crate 100 is no longer possible due to the fact that crate 100' is arranged above crate 100. Thus, crate 100 cannot be unlocked and the problems described above are avoided.

While FIGS. 12-14 describe an embodiment of the invention using a lift bar, it is noted that the invention is not restricted to such embodiments. Rather, other latching elements or locking elements may be used that allow for a disengagement of a latch with a latch counterpart and the respective elements may be structured in such a way that for assuming an unlocked position, it is necessary that at least a part of the mechanism moves above the height. For example, instead of using a lift bar, rotatable elements may be provided at both sides of the end wall that, in the locked position are in a state where they are rotated downward, however, for unlocking the latch it is required that the elements are rotated upwards in such a manner that at least a part thereof extends beyond the upper edge of the crate thereby achieving the same effect as described above when stacking a plurality of crates on top of each other. While FIGS. 12-14 described the latch mechanisms or lock mechanisms to be provided at the end walls, it is noted that the invention is not limited to such embodiments, rather the lift bar or other movable latch elements are provided in the side walls and the end walls may provide for the respective latching counter part elements.

Fourth Aspect—"Cooling Liquid Inlets"

In the following, embodiments of the invention in accordance with a fourth aspect will be described. Conventional crates as described above only provide vent holes 110 allowing for a ventilation of air through the crate. However, for various reasons, for example for rapid cooling of goods inside the crates or for maintaining goods, like vegetables, for example lettuce and the like, at a predefined temperature it may be desired to also supply a cooling liquid, preferably ice-water into the interior of the crate. Since the cooling liquid, like ice-water, may also comprise small ice particles, it is not possible to introduce a desired amount of cooling liquid through the vent holes 110 shown in FIG. 2, rather using ice-water or the like having therein respective particles will result in a blocking of the vent holes and not allowing the introduction of cooling liquid into the interior at all.

In accordance with embodiments of the invention in accordance with the fourth aspect, a crate is provided that may provide one or more inlets for allowing the cooling liquid to be introduced into the interior of the crate, wherein one or more inlets have dimensions ensuring that the cooling liquid can be introduced as desired.

Figure 15:
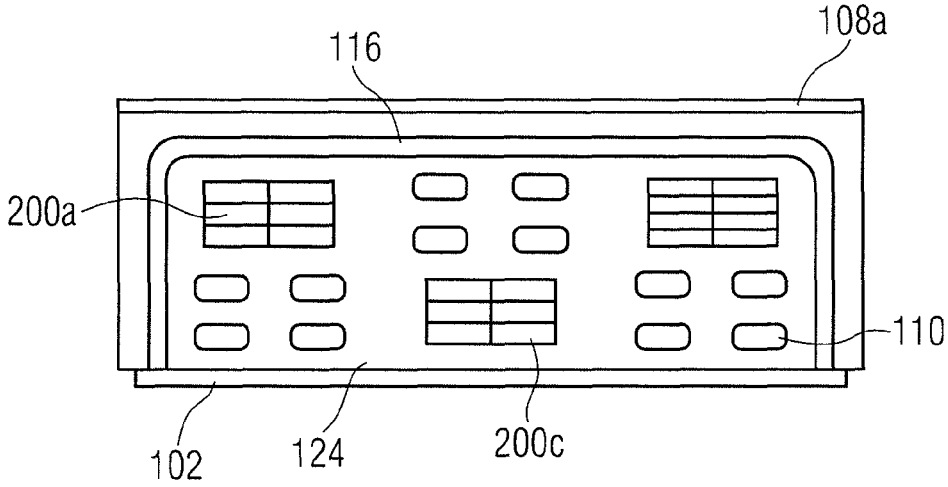
FIG. 15 shows a side view of the crate in accordance with embodiments of the fourth aspect of the invention.

FIG. 15 shows a side view of the crate in accordance with embodiments of the fourth aspect of the invention. FIG. 15 is showing a side wall 108*a* similar to the one shown in FIG. 2. The side wall 108*a* comprises the stiffening member 116 and the vent holes 110. In addition, three inlets 200*a*-200*c* are provided, wherein the first inlet 200*a* is provided at an upper left-hand corner of the side wall 108*a* adjacent to the stiffening member 116. In a similar manner, the second inlet 200*b* is provided at the upper right-hand corner of the side wall 108*a*. The third inlet 200*c* is provided at a central position of the side wall 108*a* adjacent to the lower edge 124 of the side wall 108*a* or adjacent to the bottom 102.

Figure 16:
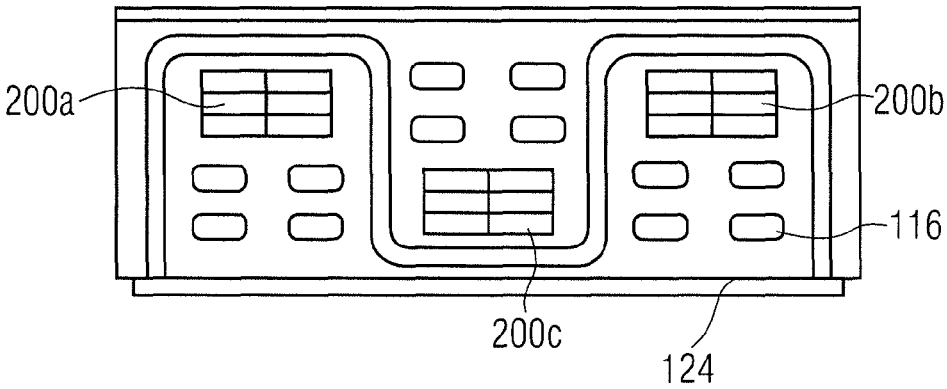
FIG. 16 shows a similar arrangement as in FIG. 15, except that the side wall has a structure as shown in FIG. 4.

FIG. 16 shows a similar arrangement as in FIG. 15, except that the side wall 108*a* has a structure as shown in FIG. 4. The stiffening member 116 has the two n-shaped portions and the one U-shaped portion there between and the inlets 200*a* and 200*b* are arranged to be in the upper end of the n-shaped portions of stiffening member 116 distant from the lower edge 124 of the side wall 108*a*. The third inlet 200*c* is provided at the bottom of the U-shaped portion of the stiffening member 116 adjacent to the lower edge 124 of the side wall 108*a*.

The arrangement of the inlet 200*a*-200*c* as shown in FIGS. 13 and 14 may be advantageous as the inlets 200*a* and 200*b* may be larger than inlet 200*c* and are provided close to the stiffening members, thereby avoiding any reduction of structural integrity of the side wall due to the provision of the inlets having a dimension being larger than the vent holes.

In accordance with embodiments, the one or more inlets 200*a*-200*c* are provided with a mesh having a mesh size that is adapted such that particles provided in the cooling liquid may pass through the mesh without blocking the inlet. While FIGS. 15 and 16 show embodiments of the fourth aspect of the invention having three inlets it is noted that the invention is not limited to such an arrangement. Rather, the number of inlets may be freely selected dependent on the needs, for example one or two inlets only may be provided or more than three inlets. Also, in accordance with embodiments of the invention, the inlets may, alternatively or in addition, be provided on the end walls.

By means of embodiments of the fourth aspect of the invention, it is ensured that sufficient cooling liquid, like ice-water may be introduced into the interior of the crates even when same are stacked on a pallet as, for example, when stacking the crates on a Euro-pallet, three crates are arranged side by side in two rows with their side walls adjacent. Thus, the crates in the center of the stack have the side walls adjacent to respective side walls of the respective outer crates, so that when applying the liquid at the outer crates with a sufficient volume it will also pass due to the large inlet to the interior of the crate. The same is true for a 5-down configuration as it may be used in the U.S. and as is shown in FIG. 3. Crates 100*a*-100*c* are provided with their side walls adjacent, thereby allowing the flow of the cooling liquid in a manner as just described. For the other two crates 100*d* and 100*e*, the cooling liquid can simply be introduced through their side walls facing the outside of the stack.

Thus, by means of embodiments of the fourth aspect of the invention, a sufficient flow of cooling liquid is ensured due to the provision of the inlet in accordance with embodiments of the invention.

In the above description of the invention, various embodiments of different aspects of a crate were described separately. However, embodiments of the invention are not limited to crates including only one of the four aspects, rather embodiments of the invention also concern a crate including one or more or all of the aspects described above. In other words, embodiments of the invention may provide a crate comprising one or more of the stiffening members in accordance with the first aspect, the movable hinges in accordance with the second aspect, the latch mechanism in accordance with the third aspect and the cooling liquid inlet in accordance with the fourth aspect.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of embodiments herein.

The invention claimed is:

1. A crate, comprising:

a bottom;

two end walls; and two side walls, wherein at least one of the two side walls comprises a plurality of vent holes and at least two inlets, the at least two inlets having a dimension larger than the vent holes such that the at least two inlets introduce a predefined amount of cooling liquid into the interior of the crate, each of the two side walls includes first and second lateral edges adjacent to the two end walls, a lower edge adjacent to the bottom and an upper edge spaced away from the bottom, at least one of the two side walls further includes a continuous, arch-shaped stiffening member extending parallel or substantially parallel to the first and second lateral edges and parallel to the upper edge, a first inlet of the at least two inlets is provided at a left portion of the at least one of the two side walls at a distance from the lower edge with a portion of the continuous stiffening member being disposed between the first inlet and the first lateral edge and the upper edge, and a second inlet of the at least two inlets is provided at a right portion of the at least one of the two side walls at a distance from the lower edge with a portion of the continuous stiffening member being disposed between the second inlet and the second lateral edge and the upper edge.

2. The crate of claim 1, wherein each of the two side walls includes the at least two inlets.

3. The crate of claim 1, wherein the continuous stiffening member includes a U-shaped portion in a central area extending towards the lower edge, wherein the first inlet is provided at the left portion of the side wall at a distance from the lower edge with a portion of the continuous stiffening member between the first inlet and the first lateral edge, the upper edge and the central area, and wherein the second inlet is provided at the right portion of the side wall at a distance from the lower edge with a portion of the continuous stiffening member between the second inlet and the second lateral edge, the upper edge and the central area.

4. The crate of claim 3, wherein in the central area, a third inlet is provided at a distance from the upper edge and with a portion of the continuous stiffening member between the third inlet and the lower edge, the left portion and the right portion.

5. The crate of claim 4, wherein the third inlet has a smaller dimension than the first and second inlets.

6. The crate of claim 1, wherein the at least two inlets include a mesh.

7. The crate of claim 1, wherein the crate is made of plastic.

* * * * *